United States Patent [19]

Ambrose et al.

[11] Patent Number: 4,534,935

[45] Date of Patent: Aug. 13, 1985

[54] MANUFACTURING OF TITANIUM ANODE SUBSTRATES

[75] Inventors: John Ambrose, Oakville; Douglas K. Charles, Mississauga; Bruce R. Conard; Carlos Diaz, both of Oakville; Charles E. O'Neill, Mississauga; Wayne P. Leavoy, Sudbury, all of Canada

[73] Assignee: INCO Limited, Toronto, Canada

[21] Appl. No.: 569,268

[22] Filed: Jan. 9, 1984

[30] Foreign Application Priority Data

Mar. 16, 1983 [CA] Canada ..... 423746

[51] Int. Cl.[3] ..... B22F 3/26; B22F 3/18; B22F 3/12

[52] U.S. Cl. ..... 419/23; 419/2; 419/25; 419/26; 419/3; 419/30; 419/38; 419/42; 419/43; 204/280; 148/126.1

[58] Field of Search ..... 419/1, 2, 3, 23, 25, 419/29, 30, 31, 38, 39, 42, 43, 48, 49, 50; 148/126.1; 204/280

[56] References Cited

U.S. PATENT DOCUMENTS 3,496,036 2/1970 Di Gambattista ..... 419/29
3,729,971 5/1973 Gurganus et al. ..... 419/42
4,029,566 6/1977 Brandmair et al. ..... 204/290
4,078,988 3/1978 Brandmair et al. ..... 204/286
4,179,289 12/1979 Brandmair et al. ..... 75/206

FOREIGN PATENT DOCUMENTS 2076859 12/1981 United Kingdom ..... 419/2

OTHER PUBLICATIONS

Goetzel Treatise on Powder Metallurgy, (1950), vol. II, pp. 692–698.

Vacuum Sintered Titanium, Fukube et al, Proceedings 4th ICVM, Section 6, pp. 272–279.

Sintered Titanium and Titanium Suboxide Anodes, Bewer et al, Titanium '80, Proceedings of the Fourth Int'l Conference on Titanium, Kyoto, Japan, 5/80, 2247–2254.

*Primary Examiner*—Teddy S. Gron
*Assistant Examiner*—T. J. Wallen
*Attorney, Agent, or Firm*—Francis J. Mulligan, Jr.; Raymond J. Kenny

[57] ABSTRACT

Sponge titanium powder is compacted, advantageously by roll compaction to a density in the range of about 60% to 80% of the density of solid titanium metal, thereafter heat treated in vacuum at about 500° C. to 750° C., cooled in vacuum to 300° C. and quenched to 100° C. to provide a substrate for electrodes useful in electrolytic processes.

9 Claims, 1 Drawing Figure

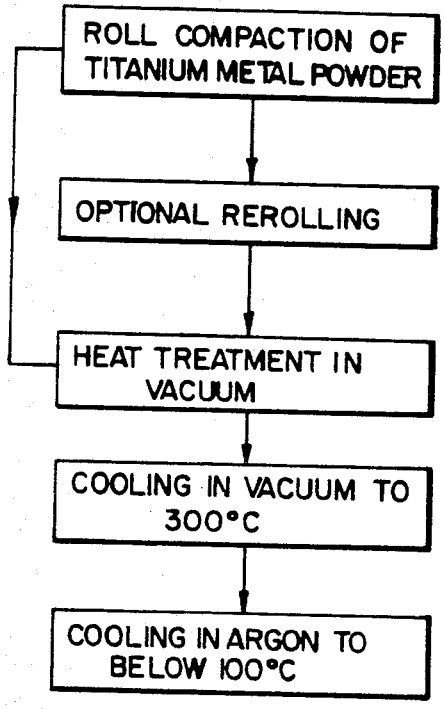
ROLL COMPACTION OF TITANIUM METAL POWDER
OPTIONAL REROLLING
HEAT TREATMENT IN VACUUM
COOLING IN VACUUM TO 300°C
COOLING IN ARGON TO BELOW 100°C

MANUFACTURING OF TITANIUM ANODE SUBSTRATES

TECHNICAL FIELD

The invention relates to the production of valve metal sheet and strip material suitable for use as the substrate for insoluble, dimensionally stable anodes useful in electrochemical processes.

BACKGROUND ART

For a considerable period of time and especially since about 1955 there have been proposals for use and the actual industrial use of insoluble, dimensionally stable anodes in electrochemical processes involving, among others, and anodic evolution of oxygen and chlorine. The term "dimensionally stable" refers to insoluble valve or film-forming metal substrate anodes which do not suffer shape modification during use as do other insoluble anodes such as, for example, graphite or Pb-based anodes. By valve metal one refers to metals, typically characterized by titanium, which permit the flow of current when used under cathodic conditions but do not permit the flow of current when used under anodic conditions due to the rapid oxidation of the metal which results in an adherent, substantially continuous non-conductive oxidic film on the metal.

Insoluble, dimensionally stable electrodes (IDS electrodes), such as disclosed in U.S. Pat. Nos. 3,103,484; 3,547,600; 3,663,414; 3,677,815; 3,773,555; 3,950,240; 3,956,083; 4,028,215; 4,070,504; 4,052,271 and variants thereof have found widespread industrial use. These IDS electrodes typically comprise a metal substrate having on and adhered to the surface thereof either some platinum-group metal or combination of platinum-group metals or some oxide or oxidic combination having reasonable electronic conductivity. The material adhering to or coating the substrate surface is insoluble in the anolyte environment in which it is to be used, and advantageously has a low overpotential for oxygen evolution. The material of the coatings on the valve metal substrate can be costly. However, the coatings are usually very thin and thus the precious metal is used in a cost-effective manner.

What is less apparent from a cost standpoint is the cost of the valve metal substrate. Commercial use of such IDS anodes generally employs relatively large sheets of valve metal or so-called expanded metal mesh of the valve metal. These substrate forms are quite expensive. In addition, the practical requirements of good current distribution over the anode make it imperative to have a substrate of low electrical resistivity. Often this low electrical resistivity requirement necessitates the welding of current carrying bus-bars to the substrate, thus adding to the complexity of anode manufacture and increasing substrate cost. Alternatively, an anode having a larger cross-sectional area can be used to give good current distribution from the top of the anode to its bottom, but by this technique s substantially greater weight of valve metal is required and therefore substrate cost increases.

While titanium prices have varied considerably in the past depending principally upon the demand for the metal in its particular forms, it is always true that the cheapest form of titanium available is sponge titanium and that sponge titanium powder, being a byproduct of sponge, is generally cheaper still.

It is the object of the present invention to provide a means and method whereby one can produce satisfactory electrode substrate sheet using titanium sponge powder at a cost substantially less than the cost of solid titanium in the form of sheet, rod or expanded mesh.

It is a further object of this invention to provide a process for manufacture of a porous substrate that can have superior electrochemical characteristics because of its relatively large surface area relative to solid titanium, the result of which is to reduce the local current density at the substrate surface or electrochemically active coated surface and thus give longer life of the substrate under service as an electrode.

SUMMARY OF THE INVENTION

In accordance with the present invention, sponge titanum powder is compacted to a density in the range of about 60–80% of the density of titanium metal and thereafter heat treated in vacuum at a temperature of about 500° to 750° C. for at least about one hour, cooled in vacuum to at least about 400° C. and quenched thereafter to at least as low as about 100° C. in an oxygen-free inert gas. The thus-produced heat-treated titanium electrode substrate material has substantial metallic characteristics. It can be handled with ease and is adapted to be coated or treated with surfacing metals or oxides as taught by the prior art to form IDS anodes. It also may be used as an electrode having metallic or oxidic impregnant in the pores as taught by Canadian Pat. No. 1,122,650 or it may be used as a cathode.

THE DRAWING

The drawing comprises a schematic flowsheet depicting the operations described in the foregoing Summary of the Invention.

BEST MODES FOR CARRYING OUT THE INVENTION

As those skilled in the art will recognize, sintering titanium powders under protective atmospheres or vacuum at high temperatures is well-known. As discussed in the 9th International Conference on Vacuum Metallurgy in 1973, it heretofore has been the general practice to sinter titanium at temperatures above 900° C. and that 1000° C. to 1200° C. sintering temperatures are preferred. These high temperatures are required for applications where the compacted powder form is required to approach the density of titanium metal, generally achieved by an additional compaction step after sintering.

It has been recognized in the present invention that when porous valve metal substrates are desired, the sintering temperature can be advantageously and dramatically reduced without degrading the usefulness of the product as an electrode. As those skilled in the art are aware, modifications and variations of the process as described below may be practiced without falling outside the scope of the invention, which is to achieve a porous electrode by low temperature sintering in vacuum.

Sponge titanium powders which have been found to be useful in the process of the present invention have an average particle size of about 50 to 150 μm as exemplified in Table I. As those skilled in the art will recognize, a powder having a wide particle size distribution is more amenable to compaction than powders having a narrow range of particle size distribution. It is noted that titanium powder purity requirements are not excessively high for the present invention. Generally powders assaying about 98% by weight titanium are satisfactory.

Compaction of the powder is preferably carried out continuously using roll compaction, but other forms of compaction may be used. Compaction can be carried out cold under ambient atmosphere and temperature to yield a green strip having a density ranging from about 60% to 80% of titanium metal, preferably about 70% to 75%. If desired, higher rolling temperatures can be employed if the rolling is carried out under an inert atmosphere. As a further alternative means, incremental compression or incremental swagging can also be employed to compact titanium powder into sheet form.

Once the titanium powder has been compacted into sheet form to provide green compact, the compact is then subjected to heat treatment in order to strengthen the incipient metal-to-metal bonds present in the green compact. According to the invention, the heat treatment is carried out in vacuum, that is, an atmosphere having a pressure no greater than about $10^{-4}$ Torr, at a temperature in the range of about 500° to 750° C. for at least one hour and preferably at about 600° C. for at least two hours. During heat up and heat treatment the vacuum is maintained by pumping so as to counter outgassing from the green compacts, and those skilled in the art will recognize that the length of time required to achieve the conditions of the present invention may be longer if gas absorption during or prior to compaction has been excessive.

After heat treating in vacuum the now-annealed compact is advantageously cooled in vacuum to about 400° C. and then is further cooled to about 100° C. in an inert gas, which may be admitted to the vacuum chamber. This is the preferred procedure because cooling to 100° C. in vacuum takes too long and cooling from 600° C. in a commercially available inert gas such as argon results in some cases in the formation of an undesirable oxide film on the compact. Despite the preference for this particular procedure, those skilled in the art will appreciate that, if time permits, cooling can be fully conducted in vacuum.

In light of the foregoing the present invention in its broadest sense comprises the steps of compacting sponge titanium powder having an average particle size of about 50 to about 40 μm to form a green sheet (or strip) having a density of about 60% to about 80% of fully dense titanium metal, thereafter heat treating the thus-produced green strip under conditions whereby formation of oxidic or more broadly, chemical species of titanium, are avoided at a temperature of about 500° to about 750° C. for at least one hour and cooling the thus heat-treated sheet to at least 100° C. under conditions whereby formation of oxidic or other chemical species of titanium are avoided, thereby providing the thus treated porous sheet the physical and mechanical properties and characteristics amenable to its use as a porous electrode or substrate thereof.

EXAMPLE 1

Each of the powders, A, B and C listed in Table I, was independently compacted using a two roll rolling mill having roll diameters of 91.44 cm×50.8 cm long with a mill gap of 0.76 mm. Green strip produced by mill forces generally on the order of 600,000 kilograms (kg) ranged in thickness between 0.287 cm to 0.33 cm. Green strip was then cut into approximately 122 cm lengths and selected pieces from each kind of powder were put through the same mill a second time, and then selected of these pieces were put through the same mill a third time. Measured densities of these compacted strips varied between 70–80% of titanium metal.

TABLE I

PARTICLE SIZE DISTRIBUTIONS OF SPONGE TITANIUM POWDERS

| Size Range (micrometers) | (Wt. %) Powder A | Powder B | Powder C |
|---|---|---|---|
| −550 + 250 | 0.0 | 0.7 | 0.0 |
| −250 + 180 | 10.5 | 2.8 | 3.5 |
| −180 + 150 | 12.3 | 4.2 | 5.3 |
| −150 + 110 | 28.1 | 28.7 | 12.3 |
| −110 + 75 | 14.3 | 25.9 | 24.6 |
| −75 + 45 | 15.8 | 28.0 | 26.3 |
| −45 | 14.0 | 9.7 | 28.0 |
| Total | 100.0 | 100.0 | 100.0 |

Selected sheets representing each powder and each pass through the mill were then hung in a vacuum furnace having a working capacity of about 1.4 $M^3$. The chamber was evacuated by vacuum pumps to a pressure of $10^{-4}$ Torr whereupon heating was started. Two and one-half hours elapsed before 600° C. was attained during which time outgassing occurred. 600° C. was maintained for 2 hours. Thereafter 13 hours was spent cooling in vacuum to 400° C. and one hour elasped during quenching to 50° C. by introducing argon gas into the chamber.

The produced sheets were strong. Calculations of electrical resistivity of the produced sheets and also of their mother green strips were made using extended lengths of strip in which potential drops were measured along the length while flowing a constant current. Table II sets forth these electrical resistivities of the various green strips and annealed strips. This table shows that the annealing treatment has improved the electrical conductivity of the sheet by about an order of magnitude.

TABLE II

SPECIFIC RESISTIVITIES (μohm-CENTIMETERS) UNDER SPECIFIC ROLLING AND HEAT TREATMENT (HT) CONDITIONS

| Metal Identification | As Rolled* | After HT | As Rolled** | After HT | As Rolled*** | After HT |
|---|---|---|---|---|---|---|
| Powder A | 1165 | 130 | 1750 | 120 | 1240 | 93 |
| Powder B | 2330 | 166 | 6585 | 205 | 3865 | 140 |
| Powder C | 3140 | 295 | 3640 | 195 | 3950 | 195 |

*Single Pass
**Double Pass
***Triple Pass

EXAMPLE 2

Powder A was compacted in a single pass according to the procedure given in Example 1. The compacted powder was further annealed in vacuum according to the procedure given in Example 1. The sintered compact was then cut into a coupon having dimensions 65 cm×5 cm×0.25 cm and a titanium rod was welded onto one end. This coupon was then coated with 1.5 mg/cm$^2$ Pd, followed by 2 mg/cm$^2$ of Ru-5%Ir according to the teachings of Canadian Pat. No. 1,129,805. This outer coating was further oxidized in air according to Canadian Pat. No. 1,129,805. An overcoat of 1 mg/cm$^2$ $RuO_2$ was then applied by providing ruthenium as a $RuCl_3$ solution in butanol coating the plated coupon with this solution, drying the coupon and then oxidizing in air at 455° C. for 15 min according to U.S. Pat. No. 4,157,943. This prepared coupon was then used as a dimensionally stable insoluble anode in electrowinning nickel from a nickel chloride electrolyte having composition (in g/L): 50 Ni, 30 total $SO_4^=$, 40 $Cl^-$ at 50° C. at a current density of 300 A/m$^2$. The coupon served in this anode mode evolving $Cl_2/O_2$ for 9 months with minor interruptions for cathode replacement. No increase in anode voltage referenced to $Hg/Hg_2SO_4$ was observed which indicated satisfactory electrochemical service.

EXAMPLE 3

Powder A was compacted in a single pass and vacuum annealed according to Example 1. A coupon measuring 5 cm×60 cm long was cut from the sintered sheet and was coated with Pd and Ru/Ir and heat treated according to Example 2, followed by overcoating with $RuO_2$ according to Example 2. The coupon was then put into service in the $NiCl_2$ electrolyte specified in Example 2 and anode voltage was measured relative to $Hg/Hg_2SO_4$ at various points along the coupon length. These voltages were equal within 5% which indicates the satisfactory conductivity of the substrate for electrochemical service.

EXAMPLE 4

Powder A was compacted into strip and annealed in vacuum as in Example 1. Coupons were cut from the annealed strip having dimensions 5 cm×10 cm. These coupons were dipped into molten Pb at 600° C. for up to 10 minutes and then cooled and excess surface Pb removed physically. The density of the coupons was measured and compared with the density of the annealed strip prior to Pb dipping and indicated that >95% of the voids in the annealed strip were impregnated by the Pb. Microscopic examination of a cross-section of selected coupons confirmed the high degree of Pb impregnation. Lead infiltrated sintered titanium sheet structures produced in this manner have exhibited ultimate tensile strengths of about 340 MPa at room temperature and non-infiltrated sintered titanium sheet structures exhibit ultimate tensile strengths of about 100 MPa.

EXAMPLE 5

Powder A was compacted according to Example 1. Green strip was cut into 48 inch (122 cm) lengths and then 35 sheets were horizontally stacked one on top of the other into the vacuum chamber in Example 1. Thereafter the chamber was evacuated to $<5\times10^{-4}$ Torr and heated to 700° C. over 11.5 h, held at 700° C. for 2 h, cooled to 400° C. over 5 h and cooled further to 100° C. in argon over 6 h. The 35 sheets showed the same electrical resistivity, within 20%, independent of their position in the stack and the average electrical resistivity was within 20% of the resistivity reported in Table I.

In this specification, titanium is used as an example of valve metals in general and the compaction and heat treatment teachings have been developed using essentially pure titanium. Those skilled in the art will appreciate that these teachings are extendable to alloys rich in titanium, i.e., alloys containing above about 80% by weight titanium, which have electrochemical characteristics as valve metals similar to those of pure titanium. For purposes of the appended claims, the term "titanium" is inclusive of such alloys.

While the present invention has been hereinbefore described in connection with the best mode known of carrying out the invention, various modifications and alterations obvious to those skilled in the art can be made. Such modifications and variations are encompassed within the ambit of the appended claims.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A process for producing electrode substrate comprising compacting sponge titanium powder to an appropriate form having a density of about 60% to about 80% of titanium metal, thereafter heat treating the thus compacted powder form at a temperature of about 500° to about 750° C. for at least one hour under conditions so as to avoid the formation of non-elemental species of titanium and cooling the thus compacted and heat treated form under conditions so as to avoid the formation of non-elemental species of titanium to a temperature of about 100° C., to thereby provide an electrode substrate having physical and mechanical properties and characteristics amenable to commercial use as an electrode including inherently low electrical resistivity that enables satisfactory current distribution over the complete surface of the electrode.

2. A process as in claim 1 wherein the sponge titanium powder has an average particle size of 50 to 150 μm and is compacted by rolling into a sheet form.

3. A process as in claim 1 wherein compaction is carried out isostatically.

4. A process as in claim 1 wherein the produced substrate form is a rod.

5. A process as in claim 2 wherein the rolling operation is conducted using multiple passes.

6. A process as in claim 2 wherein the heat treatment is conducted in vacuum.

7. A process as in claim 6 wherein, after heat treatment, the thus heat treated product is cooled in vacuum to a temperature of about 300° C.

8. A process as in claim 7 wherein the thus heat treated product is finally cooled to about 100° C. in inert gas.

9. A process as in claim 6 wherein the heat treatment is carried out at a temperature in the range of 500° C. to 750° C. for about two hours.

* * * * *